US005472394A

United States Patent [19]

Michaelson

[11] Patent Number: 5,472,394

[45] Date of Patent: Dec. 5, 1995

[54] PARACHUTE FOR ATHLETIC RESISTANCE AND SPEED TRAINING

[76] Inventor: Kyron C. W. Michaelson, 8337 Penn. Ave. S., Bloomington, Minn. 55431

[21] Appl. No.: 291,005

[22] Filed: Aug. 15, 1994

[51] Int. Cl.[6] ..... A63B 23/02

[52] U.S. Cl. ..... 482/74; 482/111; 244/142; 244/145

[58] Field of Search ..... 482/111, 74; 244/142, 244/113, 145; 446/435

[56] References Cited

U.S. PATENT DOCUMENTS

| | | |
|---|---|---|
| 1,353,130 | 9/1920 | Ruff . |
| 1,387,455 | 8/1921 | Couglin . |
| 1,485,400 | 3/1924 | Lucas . |
| 1,504,103 | 8/1924 | Davin et al. . |
| 3,459,141 | 8/1969 | Chiba . |
| 5,217,186 | 6/1993 | Stewart et al. . |

OTHER PUBLICATIONS

The Washington Times Picture, Jul. 1991.

*Primary Examiner*—Lynne A. Reichard
*Attorney, Agent, or Firm*—Joseph F. Breimayer

[57] ABSTRACT

A sport parachute for use in speed and endurance enhancement training for athletes, particularly runners, bikers, skaters, etc. engaged in recreational activities and amateur or professional sports. The parachute is provided with cords attached at one end to cord attachment points along the edge of a parachute sheet and attached together commonly at the other end thereof and to a strap, e.g. a belt, to be worn by the athlete. The cords are brought together through a resistance adjuster that alters the free length of the cords and the resulting shape of the parachute when inflated to thereby alter the drag afforded by the inflated parachute. The parachute sheet is formed with air pockets extending radially from near the center of the sheet and terminating at the cord attachment points. The drag afforded by the parachute may be adjusted by the degree of opening of the pockets and the spreading apart of the cord attachment points. A quick release mechanism allows the release of the parachute while the athlete is moving to effect an over-speed condition.

19 Claims, 4 Drawing Sheets

PARACHUTE FOR ATHLETIC RESISTANCE AND SPEED TRAINING

FIELD OF THE INVENTION

This invention relates to an aid in the form of a sport parachute (or chute) for use in speed and endurance enhancement training for athletes, particularly runners and skaters engaged in recreational activities and amateur or professional sports.

BACKGROUND OF THE INVENTION

Athletes frequently employ a drag, weight or impedance which act as a restraint and requires greater than normal efforts to overcome for strength speed and endurance training purposes. For example, weights may be strapped on the athlete's body prior to running or skating to force the exertion of greater effort to reach the athlete's normal running or skating speed or to run or skate a certain distance. Once removed, the athlete may achieve an increase in peak speed and endurance over the same distance. The selection of the appropriate weight, the distribution and attachment of weights to the body, and the formulation of training regimens is difficult. Moreover, the weights are relatively expensive, difficult to adjust, uncomfortable, and inconvenient to store and transport due to the number of sizes needed and their bulk and weight.

In recent years, speed and endurance training devices have increased in popularity with individuals and amateur and professional sports teams. A wide variety of equipment and training regimens have been devised for athletes engaged in all sports, including soccer, ice hockey, track and field, football, basketball, baseball, swimming and the like. Athletes have employed weighted skid sleds strapped by a cord to a belt and pulled while running across a natural or artificial turf field or weighted skid sleds that are pushed. One of the more recently developed and popular training regimens involves using the wind or water for resistance through the use of a strapped-on air chute during running or "sea anchor" like, water chute during swimming.

For example, U.S. Pat. No. 5,217,186 discloses a square shaped parachute sheet having a number of parachute lines or cords attached to it, the cords drawn through a cord spacing disk to avoid cord entanglement and attached to a strap worn by the athlete. Upon running, the parachute is intended to open in the wind and present a drag on the running athlete. Generally, the resistance afforded by the inflated parachute is dependent on the size and shape of the parachute and increases with the speed attained in running or skating with the inflated parachute. In a training regimen, the athlete runs or skates to a peak speed with the parachute attached and then releases the parachute, experiencing a momentary burst in speed. As this process is repeated, the athlete is able to progressively increase the peak speed and endurance attained without the parachute. Apparently, the ability to run or skate faster is first experienced and then learned in the process.

Sports parachutes of the type described in the '186 patent and marketed prior to the present invention have suffered from an inability to fine tune the resistance attained with a single parachute for athletes of varying weight and height. Moreover, in the training regimen of a single athlete, it is desired to change and increase the resistance as the athlete's performance improves. It has been necessary to stock or acquire a variety of parachute sheet sizes to accommodate a single athlete's improvement in performance.

In addition, the square parachute sheet of the '186 patent does not always catch the wind adequately to remain inflated, particularly during turns. The large number of cords are also difficult to keep from tangling, a problem addressed by the disk of the '186 patent.

Similar problems are experienced with other prior art parachute designs for use in speed training. Long lines can get tangled easily. The parachute shapes also fail to readily provide lift, and the inflated parachutes are unstable in both straight movement and on turning.

SUMMARY OF THE INVENTION

It is therefore an object of the invention to provide an improved sport parachute for exerting a desired, adjustable drag or impedance on an athlete moving while accelerating or at speed.

It is a further object of the invention to provide an improved athletic training parachute that catches the wind easily and remains aloft while changing direction and is readily adjusted to present a drag appropriate to the training regimen and the athlete's size and physical condition.

It is a still further object of the invention to provide such a sports parachute with a minimal number of cords subject to tangling in use or in storage.

These and other objects of the invention are realized in an athletic training or sports parachute provided with cords attached at one end to cord attachment points along the edge of a parachute sheet and attached together commonly at the other end thereof and to a strap, e.g. a belt, to be worn by the athlete, wherein the cords are brought together through a resistance adjuster that alters the free length of the cords and the resulting shape of the parachute when inflated to thereby alter the drag afforded by the inflated parachute. Preferably, the resistance adjuster comprises an adjustable locking mechanism for locking the cords together at a selected position along the length of the cords between the sheet and the common attachment point, thereby defining a free length of the cords. The adjustable locking mechanism is formed with an orifice through which the cords extend and a thumb actuated, spring loaded catch for frictionally securing the cords in the orifice. Selection of an appropriate free length of the cords may be accomplished by releasing the catch, sliding the mechanism along the cords to the desired position and again engaging the catch.

The parachute sheet is preferably formed in a generally square shape, but with four expanded corner, air catching pockets attached to four cords at four corners. The parachute sheet is thus formed with the four air pockets extending radially from near the center of the sheet and terminating at the cord attachment points. The drag afforded by the parachute may be adjusted by the degree of opening of the pockets and the spreading apart of the cord attachment points.

The adjustable resistance and shape of the inventive parachutes provide a safe and efficient way to build strength, speed and endurance and help athletes break plateaus or speed barriers by changing their method of training. When running or skating with the inventive parachutes, an athlete will develop increased takeoff power and special muscle strength which will improve stride length and running form. It is important that an athlete run or skate with a variation of parachute sizes or combinations of parachutes, and in accordance with the present invention, the athlete can adjust the amount of drag the parachute(s) produces by sliding the resistance adjuster up or down the parachute(s) cords. In following a prescribed training regimen, the cords may be marked along their length with fabric markers so that a series of settings may be established for training the same athlete or different athletes.

The adjustable resistance parachutes of the present invention help achieve different training goals such as speed endurance, strength endurance, start acceleration and explosiveness. The experience of the momentary acceleration exceeding a plateau provides a biomechanical effect causes the body to learn to break the previous plateau unaided by the parachute and therefore increase athletic performance.

BRIEF DESCRIPTION OF THE DRAWINGS

These other objects, advantages and features of the present invention will be more readily understood from the following detailed description of the preferred embodiments thereof, when considered in conjunction with the drawings, in which.

DETAILED DESCRIPTION OF THE PREFERRED EMBODIMENTS OF THE INVENTION

Figure 1:
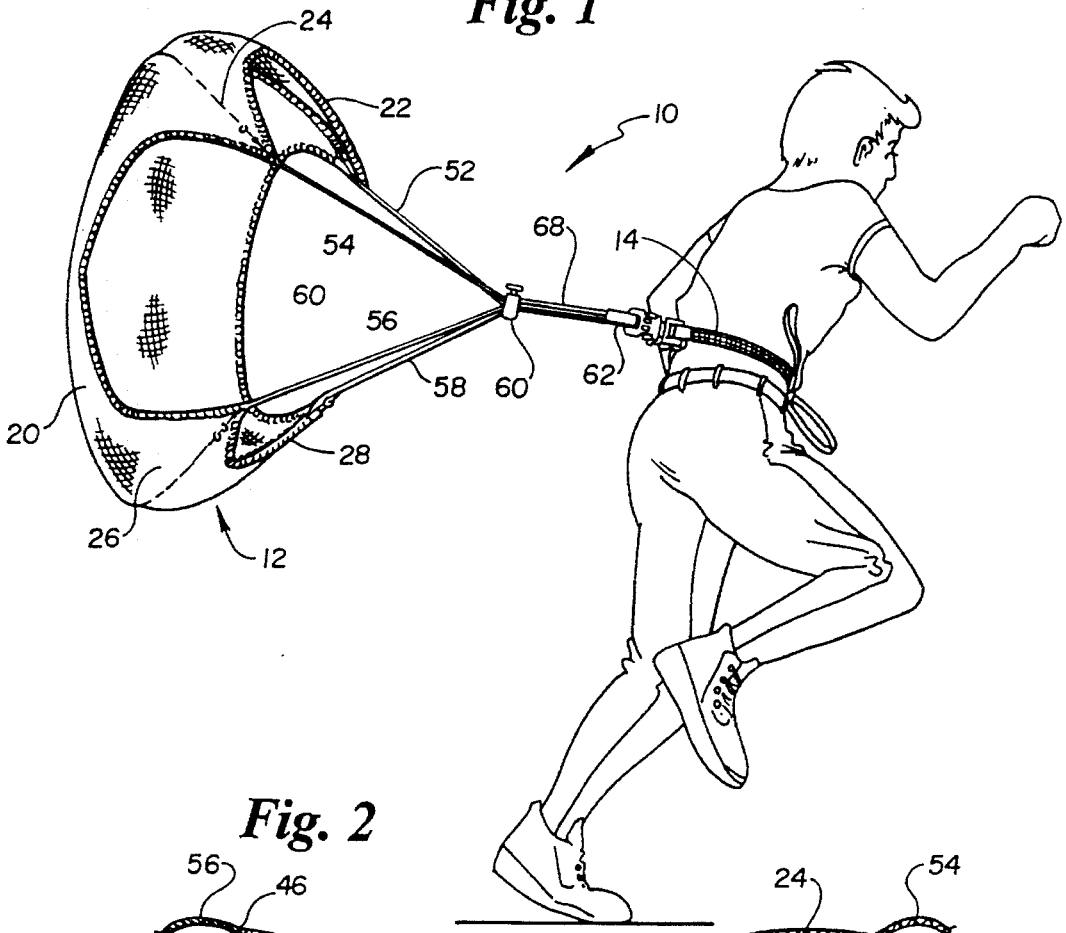
FIG. 1 is a side view of a runner with a parachute in accordance with the invention inflated by air and raised off the ground and trailing behind the runner.

Referring now to FIG. 1, an athlete 10 to whom the parachute 12 of the present invention is attached by a strap or belt 14 and who is moving with respect to the ground. The athlete 10 may be a skater, a runner, a bicyclist or other rapidly moving person, for example an ice skater on ice, a water skier on water, a roller skater or biker on pavement, etc. The parachute 12 may also be used on animals such as racing dogs or race horses.

Figure 2:
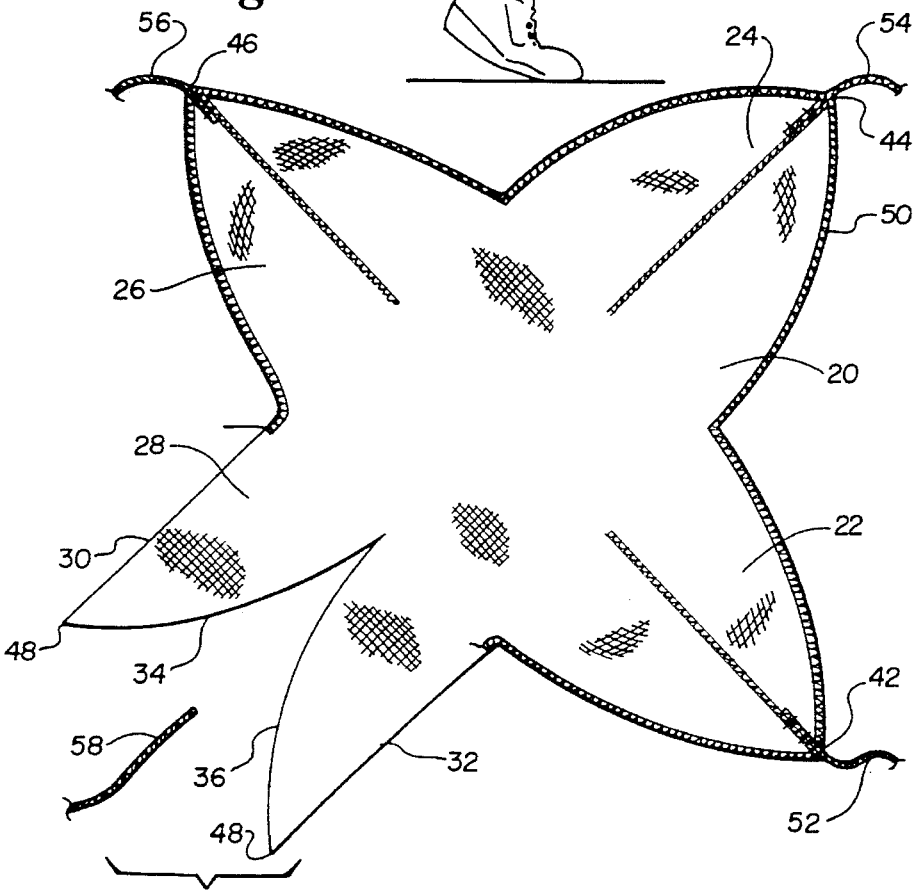
FIG. 2 is a plan view of the parachute sheet of FIG. 1 in a flat open condition prior to sewing all of the corner flaps together.

Referring to FIG. 2 as well as FIG. 1, the parachute 12 comprises a sheet 20 which is preferably generally rectangular, for example, approximately square in shape, but cut to the pattern shape shown in FIG. 2, before sewing. The sheet 20 is of any suitable material, but is preferably rip-stop nylon, which, when fabricated into the shape of the inventive parachute, is light enough in weight that it will open up readily when inflated with air during movement of the athlete at approximately a speed of about 5 miles per hour. The material of sheet 20 is of sufficiently tight weave to present a resistance to air when inflated at such a speed. The area of the sheet 20 will vary depending upon the size, weight, and athletic ability of the runner and the type of training desired as described hereafter.

The generally square shape is thus modified by the formation of four parabolic cups or air pockets 22, 24, 26, 28 created at the four corners by sewn-together ears or flaps, e.g. flaps 30 and 32 of pocket 28. The eight flaps each have parabolic curved mating edges, e.g. edges 34 and 36 of flaps 30 and 32 (shown prior to sewing), respectively, that are sewn together to form the air pockets. Each air pocket 22, 24, 26, 28 therefore has a rib or spine at the sewn together edge portions of the sheet 20 that extend outward radially from the center of sheet 20. The sewn together rib or spine of each pocket 22, 24, 26, 28 terminates in a cord attachment point 42, 44, 46, 48, respectively. The resulting free sheet edge is therefor scalloped, to a greater or lesser degree depending on the shape of the sewn together mating edges, between the adjacent cord attachment points at the ends of the air pockets. The sheet free edge is preferably formed with a sewn hem 50 extending as a fray resistant border around its periphery in the segments of the sheet edge that are not sewn together to form the air pockets 22, 24, 26, 28.

As shown in FIG. 1, the parachute sheet is inflated by air as the athlete moves at speed. The parachute sheet 20 is thus formed and fills with air with the air pockets 22, 24, 26, 28 extending radially from near the center of the sheet 20 and terminating at the cord attachment points 42, 44, 46, 48. The drag afforded by the parachute may be adjusted by adjusting the degree of opening of the air pockets 22, 24, 26, 28 and the spreading apart of the cord attachment points 42, 44, 46, 48.

Four lines or cords 52, 54, 56 and 58 are attached at one end thereof to the attachment points 42, 44, 46 and 48, respectively, and extend through a resistance adjuster 60 to a common connection 62 of the other ends of the cords. The common connection 62 includes a snap female connector 70, that is shown in greater detail in FIG. 4, that snaps into one of the mating male connectors 72 or 74, also shown in FIG. 4 attached to the belt 14. The female and male connectors 70 and 72, 74 comprise conventional, plastic clips connectors well known in the art. Two parachute connectors 70 may therefore be attached to the depicted belt 14, but additional male connectors may be added to add more parachutes.

Figure 3:
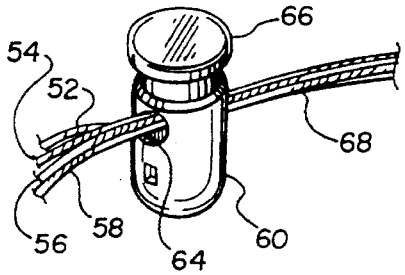
FIG. 3 is a view on a larger scale than that of FIGS. 1 and 2 of the several parachute cords in proximity to the runner belt showing how they are attached to or pass through a slidable resistance adjuster.

Turning now to the resistance adjuster 60 depicted in FIG. 3, it provides an adjustable locking mechanism for frictionally engaging the four cords 52, 54, 56 and 58 at a selected position along their lengths intermediate of the cord attachment points and the common connection 62. The resistance adjuster 60 includes an orifice 64 through which the cords 52, 54, 56, 58 extend and a thumb actuated, spring loaded push button catch 66 for releasing the cords for slidable movement along the lengths thereof when depressed by the athlete's thumb and for frictionally securing the cords together in the orifice 64 under the influence of the internally disposed spring loaded catch when released by the thumb.

The position of the resistance adjuster 60 determines the relative lengths of the segments of the cords 52, 54, 56, 58 between the set position of the resistance adjuster 60 along the cords and the common cord attachment point 62, illustrated as the restrained segment length 68 in FIG. 3. The restrained segment length 68 is equal for all four cord segments, unless an effort is made to manually pull one or more of the cords through the orifice 62 in relation to the remaining cords. Ordinarily, an equal restrained segment length 68 for all four cords is preferred.

In accordance with the invention, the resistance afforded by the inflated parachute depends on the volume of air blocked by and asserting drag on the parachute sheet 20. This in turn depends on how wide the cord attachment points 42, 44, 46, 48 of the four air pockets 22, 24, 26, 28 are allowed to spread apart. The spread open width is therefore a function of the restrained segment length 68 in relation to the remaining free segment lengths of the cords 52, 54, 56, 58 between the resistance adjuster 60 and the attachment points 42, 44, 46, 48, and can be adjusted readily by selective positioning of the resistance adjuster 60 along the cord lengths.

Figure 4:
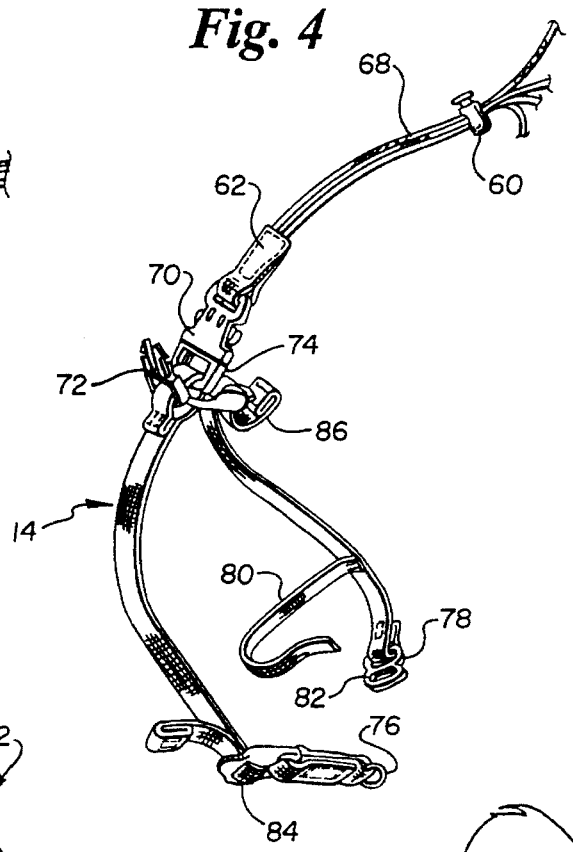
FIG. 4 is a partial view showing the attachment belt worn by the athlete with the quick release strap and the slidable resistance adjuster.

Turning now to details of the strap or belt 14 and the quick release mechanism, FIG. 4 shows the attachment belt 14 having the two male connectors 72, 74 approximately midway along the length of the belt 14. At one end of the web belt 14, a D-ring 76 is attached, and at the other end, a metal band 78 and a webbing extension 80 are attached. When the belt 14 is placed around the athlete's waist and adjusted to fit, the D-ring 76 is intended to be placed through a slot 82 in the metal band 78, and the free end of the webbing extension 80 is inserted through the D-ring 76 to hold the ends of the belt 14 together.

One (or more) snap female connector 70 of the parachute 12 is snapped over one of the male connectors 72, 74. The belt 14 may be positioned around the waist to position the parachute 12 behind the athlete 10 for forward movement or be rotated around the waist to position the parachute 12 in front of the athlete 10, particularly for adding resistance when skating backwards. The belt may be adjusted to fit the waist properly by pulling the webbing through a ladder-lock adjuster 84 on one end thereof. If more adjustment is needed, another ladder-lock adjuster 86 on the back of the belt 14 may be adjusted.

Figure 5:
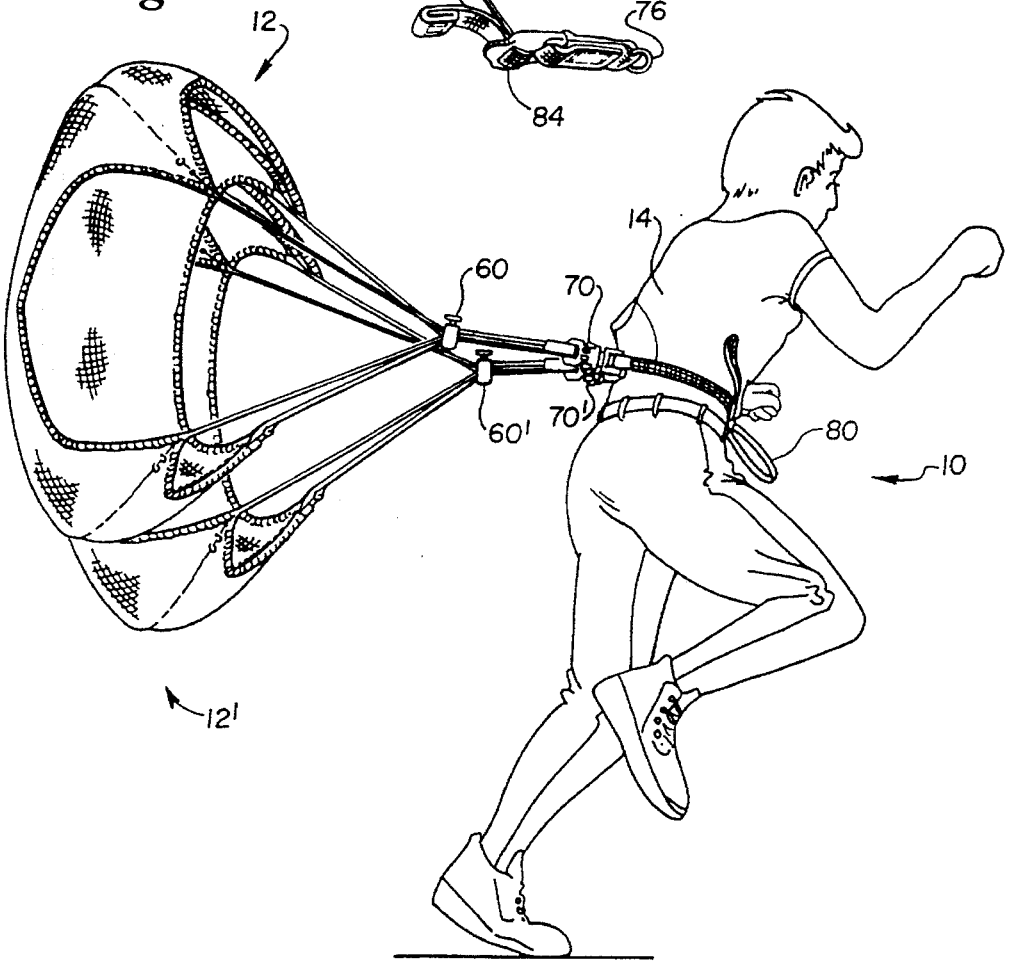
FIG. 5 is a side view of a runner with two sports parachutes of the present invention attached to the belt of FIG. 4 and inflated by air and raised off the ground and trailing behind the runner.

FIG. 5 shows an athlete having two parachutes 12, 12' attached to the belt 14. When either one or two parachutes are attached, the athlete can adjust the cord segment length to achieve a great degree of resistance variability. In use, the athlete 10 will attach the parachute(s) 12, 12' to the belt 14 around his waist as shown in FIGS. 1 and 5 and will commence moving. The parachute sheet 20 will open and rise from the ground to the position shown in FIGS. 1 and 5 as air fills up and bears against the parachute sheet 20.

Figure 7:
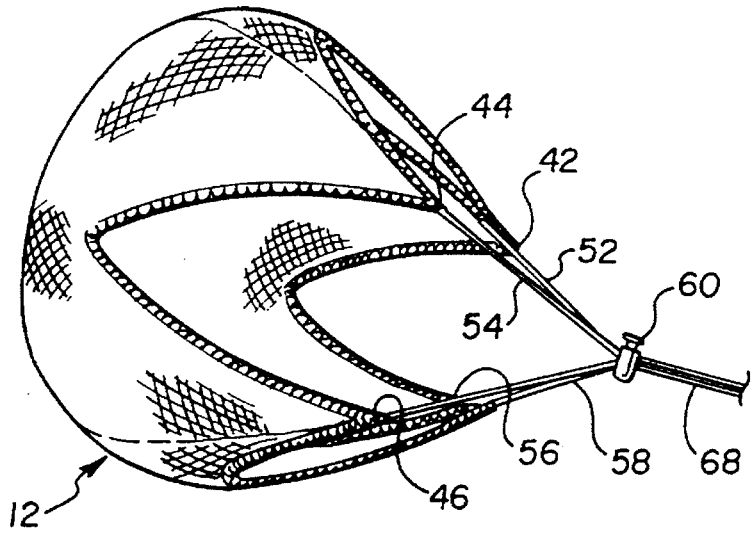
FIG. 7 is a perspective view of an inflated parachute opened up by the resistance adjuster position to increase wind resistance.
Figure 6:
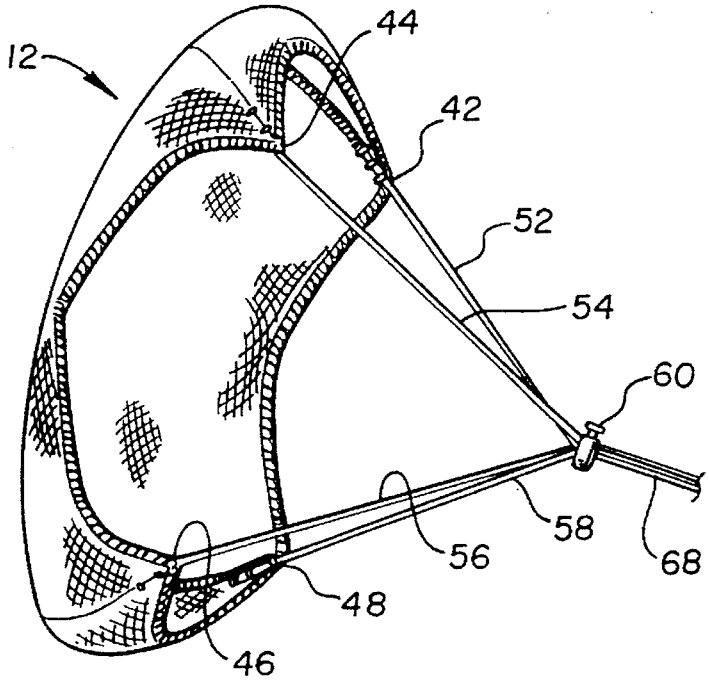
FIG. 6 is a perspective view of an inflated parachute drawn tight by the resistance adjuster position to decrease wind resistance.

FIGS. 6 and 7 show that the wind resistance may be varied by adjustment of the resistance adjuster 60 along the cords 52, 54, 56, 58. In FIG. 6, the adjuster 60 is positioned close to the cord attachment points 42, 44, 46, 48, resulting in a lengthened cord segment length 68. The corner attachment points 42, 44, 46, and 48 are drawn together, and the pockets 22, 24, 26 and 28 are not able to fill out. Consequently, since the trapped air volume is smaller, the resistance afforded by the parachute 12 is lessened.

In FIG. 7, the adjuster 60 is positioned farther away from the cord attachment points 42, 44, 46, 48, resulting in a shortened cord segment length 68. The corner attachment points 42, 44, 46, and 48 are allowed to spread apart, and the pockets 22, 24, 26 and 28 fill out with trapped air. Consequently, since the trapped air volume is larger, the resistance afforded by the parachute 12 is increased.

In both of the cases of FIGS. 6 and 7 (and in other intermediate and extreme positions afforded by the positioning of the resistance adjuster 60), the parachute 12 (and additional attached parachutes) fill easily with air and are stable at high and low speed. The air pockets 22, 24, 26 and 28 catch the air and fill out the parachute readily on movement from a standing start and on cornering and reversing direction. The use of only four cords 52, 54, 56, 58 running through the resistance adjuster 60 minimizes twisting entanglement of the cords with either one or two attached parachutes 12.

The parachute cords 52, 54, 56 and 58 are preferably on the order of eight feet long. In use of the adjuster 60, coaches or athletes may choose to set up training regimens at various settings along the cords by marking off distances on the cords with a fabric marker thereby establishing a series of restrained segment lengths 68 between the maximum and minimum settings. Moreover, the parachutes 12 are provided in different sizes for use alone or in pairs depending on the athletes size, level of fitness and the particular sport or training program being pursued. The parachute sizes dictate the maximum resistance that can be attained at the greatest resistance setting as is shown in FIG. 6. For example, speed and resistance training for professional football players may require extra large parachutes, whereas sprinters and distance runners may require small parachutes. The small, medium, large and extra-large parachutes may be fabricated in the pattern of FIG. 2 from square sheets of fabric 20 that are 48", 72", 96" and 120" square before cutting to shape.

Returning to FIGS. 1 and 5, after moving at speed for a certain time, the athlete may grasp the webbing extension 80 and pull its free end out of the D-ring 76, causing the belt 14 to fall off. When the release occurs, an over-speed condition is created. The athlete will feel an accelerated sensation of running, skating or biking faster than a previous plateau reached without use of the parachute and will increase stride or stroke frequency and length. By endeavoring to maintain the accelerated frequency and length for a period after release of the parachute, the body overcomes a previously established mental threshold, resulting in higher performance achievement than thought possible. This biomechanical effect of most sports training efforts is enhanced by this technique, particularly as the resistance can be fine-tuned by the setting of the resistance adjuster 60.

Figure 8:
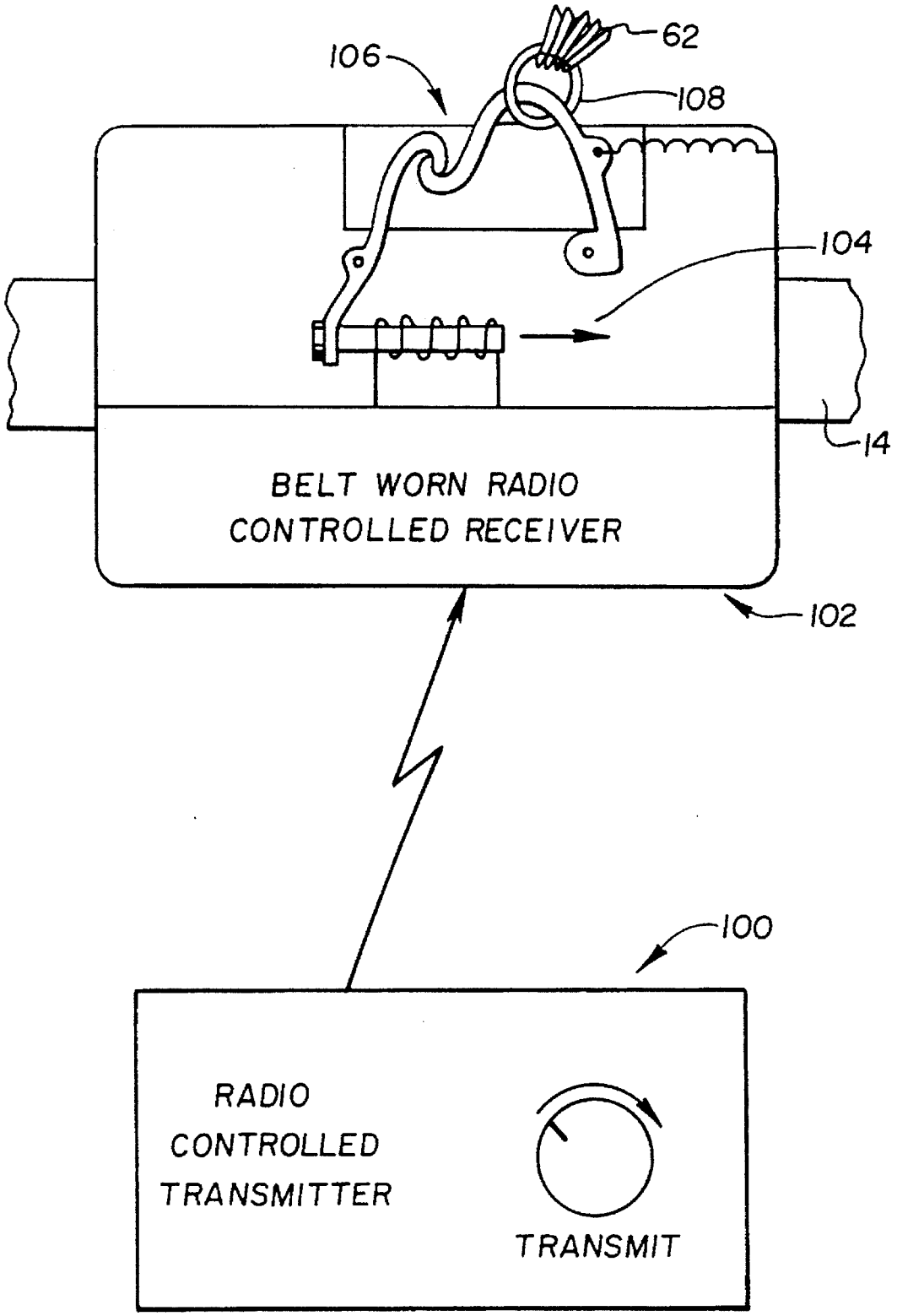
FIG. 8 is a schematic illustration of a radio controlled release system for remotely releasing the parachute from the athlete's body while the athlete is moving.

Turning now to FIG. 8, the quick release may also be effected remotely by a coach or trainer while the athlete is moving by using a radio controlled transmitter 100 and a receiver 102 mounted on the belt 14. The receiver 102 includes a solenoid 104 coupled to a spring loaded catch 106 that is drawn around a loop 108 at the common connection 62 when the parachute is attached. Actuation of the transmitter 100 generates a signal received by the receiver 102 to energize the solenoid 104 which pulls in and releases the catch 106. In this way, the trainer can effect the release at an appropriate point while the athlete concentrates on skating or running. This remote release system of FIG. 8 is also useful for training racing dogs and other animals. This system is also useful for other training systems, e.g. athletic weight bearing sleds or other resistances that may be attached to an athlete and released quickly. A radio controlled transmitter useful in this quick release system is any of the model airplane remote control units manufactured by Futaba.

The inventive sport parachutes allow the athlete to create his or her own training program according to the specific demands of the sport in which he or she participates and the athlete's own physical condition. The particular configuration of the parachute sheet 20 and the adjustable resistance afforded by the setting of the resistance adjuster are not just for running straight ahead. The athlete can run or skate backwards or change directions abruptly, and the inflated parachute will follow the change in direction without spilling air and loss of resistance. In specific sports e.g. baseball or basketball, the athlete can practice running bases or performing layups or passing drills. Football players can change directions, make weaving motions or lateral movements or run backwards.

As stated above, the parachute of the invention with its quick release and resistance adjustment features may be used on human athletes (runners, skaters, ball players, etc.) and preferably attached to a belt, as shown in FIGS. 1 and 5, or it may be attached to animals (racing dogs, race horses, etc.) in which case the parachute may be attached to a collar or saddle.

Although several embodiments of the present invention have been illustrated in the accompanying drawings and described in the foregoing detailed description, it will be understood that the invention is not limited to the particular embodiments described herein, but is capable of numerous rearrangements, modification and substitutions without departing from the scope of the invention. The following claims are intended to encompass all such modifications.

PARTS LIST FOR FIGS. 1–7 athlete 10
parachute 12
strap or belt 14
parachute sheet 20
air pockets 22, 24, 26, 28
ears or flaps 30 and 32
edges 34 and 36
cord attachment points 42, 44, 46, and 48
sewn hem 50
lines or cords 52, 54, 56 and 58
resistance adjuster 60
common connection 62
orifice 64
thumb actuated, spring loaded catch 66
restrained segment length 68
snap female connector 70
mating male connectors 72 or 74
D-ring 76
metal band 78
webbing extension 80
slot 82
ladder adjusters 84, 86

I claim:

1. An athletic speed and endurance training parachute comprising:

a parachute sheet cut into a pre-formed shape having a peripheral edge and a plurality of cord attachment points separated by sheet free edge segments;

a plurality of elongated cords each attached at one end to the plurality of cord attachment points of said parachute sheet and connected together commonly at the other end thereof;

a strap adapted to be worn by an athlete and having means for attaching the commonly connected ends of said cords thereto; and resistance adjuster means positionable along the lengths of said cords between said commonly connected ends and said parachute sheet attachment points for adjusting the free lengths of the cords and the resulting drag afforded by the parachute when inflated by air in response to movement of the athlete, said resistance adjuster means including releasable locking means having an engaged state for engaging said cords to prevent movement of said resistance adjuster means for speed and endurance training and a released state for releasing said cords and allowing positioning of said resistance adjuster means along said cords to a selected position along the lengths of said cords to adjust said free lengths.

2. The training parachute of claim 1 wherein said releasable locking means further comprises an adjustable locking mechanism for embracing and locking the cords together at a selected position along the lengths of the cords between the sheet attachment points and the common connection, thereby defining a free length and a restrained length of the cords.

3. The training parachute of claim 2 wherein said adjustable locking mechanism further comprises an orifice through which the cords extend and a spring loaded catch for releasing the cords for slidable movement along the lengths thereof when thumb actuated and for frictionally securing the cords together in the orifice under the influence of the spring loaded catch when released by the thumb.

4. The training parachute of claim 3 wherein:

said parachute sheet is formed with a plurality of curved panels terminating in said plurality of cord attachment points which, when inflated, form a plurality of expanded air catching pockets attached to said plurality of cords, said air catching pockets being adjustable in shape in dependence on the free lengths of the cords established by the position of said resistance adjuster means along the lengths of said cords.

5. The training parachute of claim 4 wherein said parachute sheet is generally square in shape having four curved panels formed in the four corners thereof which, when expanded by air, form four catching pockets and having four cord attachment points formed at the tips of said expanded air catching pockets for attachment to four cords.

6. The training parachute of claim 5 wherein the four peripheral edges of said parachute sheet extending between said four cord attachment points are curved and form a scalloped shape when said parachute sheet is expanded by air during movement.

7. The training parachute of claim 6 wherein said strap further comprises means for allowing a quick release of said parachute from the athlete's body during movement so that the drag provided by the inflated parachute may be released to effect an over-speed condition for enhanced speed training.

8. The training parachute of claim 1 wherein:

said parachute sheet is formed with a plurality of curved panels terminating in said plurality of cord attachment points which, when inflated, form a plurality of expanded air catching pockets attached to said plurality of cords, said air catching pockets being adjustable in shape in dependence on the free lengths of the cords established by the position of said resistance adjuster means along the lengths of said cords.

9. The training parachute of claim 8 wherein said parachute sheet is generally square in shape having four curved panels formed in the four corners thereof which, when expanded by air, form four catching pockets and having four cord attachment points formed at the tips of said expanded air catching pockets for attachment to four cords.

10. The training parachute of claim 9 wherein the four peripheral edges of said parachute sheet extending between said four cord attachment points are curved and form a scalloped shape when said parachute sheet is expanded by air during movement.

11. The training parachute of claim 10 wherein said strap further comprises means for allowing a quick release of said parachute from the athlete's body during movement so that the drag provided by the inflated parachute may be released to effect an over-speed condition for enhanced speed training.

12. The training parachute of claim 11 wherein said quick release means comprises a remote radio controlled transmitter and a body worn receiver, said radio controlled transmitter being selectively operable to transmit a signal to said receiver to release the parachute from the athlete's body while the athlete is moving.

13. The training parachute of claim 1 wherein said strap further comprises quick release means for allowing a quick release of said parachute from the athlete's body during movement so that the drag provided by the inflated parachute may be released to effect an over-speed condition for enhanced speed training.

14. The training parachute of claim 13 wherein said quick release means comprises a remote radio controlled transmitter and a combined body worn receiver and release means, said radio controlled transmitter being selectively operable to transmit a signal to said receiver and release means to release the parachute from the athlete's body while the athlete is moving.

15. The training parachute of claim 14 wherein said remote controlled receiver and release means further comprises:

a spring actuated latch mechanism having an open and a closed position and operable in said closed position for engaging said commonly connected ends of said cords and operable in said open position for releasing said commonly connected ends of said cords from said body attachment means;

a radio controlled receiver responsive to a transmitted signal for generating a release signal; and means responsive to said release signal for operating said spring actuated release latch mechanism in said second position.

16. The training parachute of claim 14 wherein said remote controlled receiver and release means further comprises:

latch means operable in a first position for engaging said commonly connected ends of said cords and operable in a second position for releasing said commonly connected ends of said cords from said body attachment means;

a radio controlled receiver responsive to a transmitted signal for generating a release signal; and means responsive to said release signal for operating said latch means in said second position.

17. An athletic speed and endurance training parachute comprising:

a parachute sheet cut into a pre-formed shape having a peripheral edge and a plurality of cord attachment points separated by sheet free edge segments;

a plurality of elongated cords each attached at one end to the plurality of cord attachment points of said parachute sheet and connected together commonly at the other end thereof;

body attachment means adapted to be worn by an athlete for attaching the commonly connected ends of said cords to the athlete's body; and remote controlled quick release means for allowing a quick release of said body attachment means to release said parachute from the athlete's body during movement so that the drag provided by the inflated parachute may be released to effect an over-speed condition for enhanced speed training, said quick release means further comprising radio controlled receiver and release means responsive to a transmitted radio control signal for releasing said parachute from the athlete's body while the athlete is moving.

18. The training parachute of claim 17 wherein said remote controlled receiver and release means further comprises:

a spring actuated latch mechanism having an open and a closed position and operable in said closed position for engaging said commonly connected ends of said cords and operable in said open position for releasing said commonly connected ends of said cords from said body attachment means;

a radio controlled receiver responsive to a transmitted signal for generating a release signal; and means responsive to said release signal for operating said spring actuated release latch mechanism in said second position.

19. The training parachute of claim 17 wherein said remote controlled receiver and release means further comprises:

latch means operable in a first position for engaging said commonly connected ends of said cords and operable in a second position for releasing said commonly connected ends of said cords from said body attachment means;

a radio controlled receiver responsive to a transmitted signal for generating a release signal; and means responsive to said release signal for operating ,said latch means in said second position.

* * * * *